US006695407B1

(12) United States Patent
Lin

(10) Patent No.: US 6,695,407 B1
(45) Date of Patent: Feb. 24, 2004

(54) HEIGHT ADJUSTING DEVICE FOR STOOL

(76) Inventor: Ming-Chuan Lin, 11F-2, No.43, Chai-I Street, Taichung City (TW)

( * ) Notice: Subject to any disclaimer, the term of this patent is extended or adjusted under 35 U.S.C. 154(b) by 0 days.

(21) Appl. No.: 10/227,514

(22) Filed: Aug. 26, 2002

(51) Int. Cl.[7] ..... A47C 7/50

(52) U.S. Cl. ..... 297/423.38; 297/461; 297/344.18; 297/423.19; 248/161; 248/230.2

(58) Field of Search ..... 297/423.19, 423.25, 297/423.38, 344.18, 461; 248/161, 230.2, 231.31

(56) References Cited

U.S. PATENT DOCUMENTS 3,754,787 A * 8/1973 Garber ..... 297/423.38
4,408,801 A * 10/1983 Edel et al. ..... 297/423.38
4,623,195 A * 11/1986 Avella ..... 297/423.38
5,385,323 A * 1/1995 Garelick ..... 248/161
5,988,754 A * 11/1999 Lamart et al. ..... 297/423.38

FOREIGN PATENT DOCUMENTS

JP 6-181827 * 12/1992 ..... 297/423.25

* cited by examiner

*Primary Examiner*—Anthony D. Barfield
(74) *Attorney, Agent, or Firm*—Charles E. Baxley

(57) ABSTRACT

A stool includes a base and a post extending from a top of the base with a seat pivotably connected to a top of the post. A foot rest has a collar through the post extends and a recess is defined in an inner periphery of the collar. A cam member is received in the recess and a lever is connected to the cam member. A fastening member is received in the collar and mounted to the post. The cam member urges against an outside of the fastening member by operating the lever.

4 Claims, 5 Drawing Sheets

HEIGHT ADJUSTING DEVICE FOR STOOL

FIELD OF THE INVENTION

The present invention relates to a stool that has an adjustable post so that the height of the stool can be adjusted according the users.

BACKGROUND OF THE INVENTION

A conventional is shown in FIG. 1 and generally includes base 100 and a post 200 extends from a top of the base 100. A seat 300 is connected to a top end of the post 200 and a foot rest 400 is welded onto the post 200. The distance between the seat 300 and the foot rest 400 is fixed so that only some of the users feel comfortable for the distance and others feel that they need the foot rest to be located at a closer or a remote position. Unfortunately, the foot rest 400 is welded on the post 200 so that the position of the foot rest cannot be changed.

The present invention intends to provide a stool that has an adjustable foot rest which is movable on the post by operating a lever to activate a cam device.

SUMMARY OF THE INVENTION

In accordance with one aspect of the present invention, there is provided a stool which comprises a base and a post extends from a top of the base and a seat is pivotably connected to a top of the post. A foot rest has a collar and a recess is defined in an inner periphery of the collar. The post extends through the collar and a cam member is received in the recess. A lever is eccentrically connected to the cam member. A fastening member s received in the collar and mounted to the post. The cam member urges against an outside of the fastening member.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
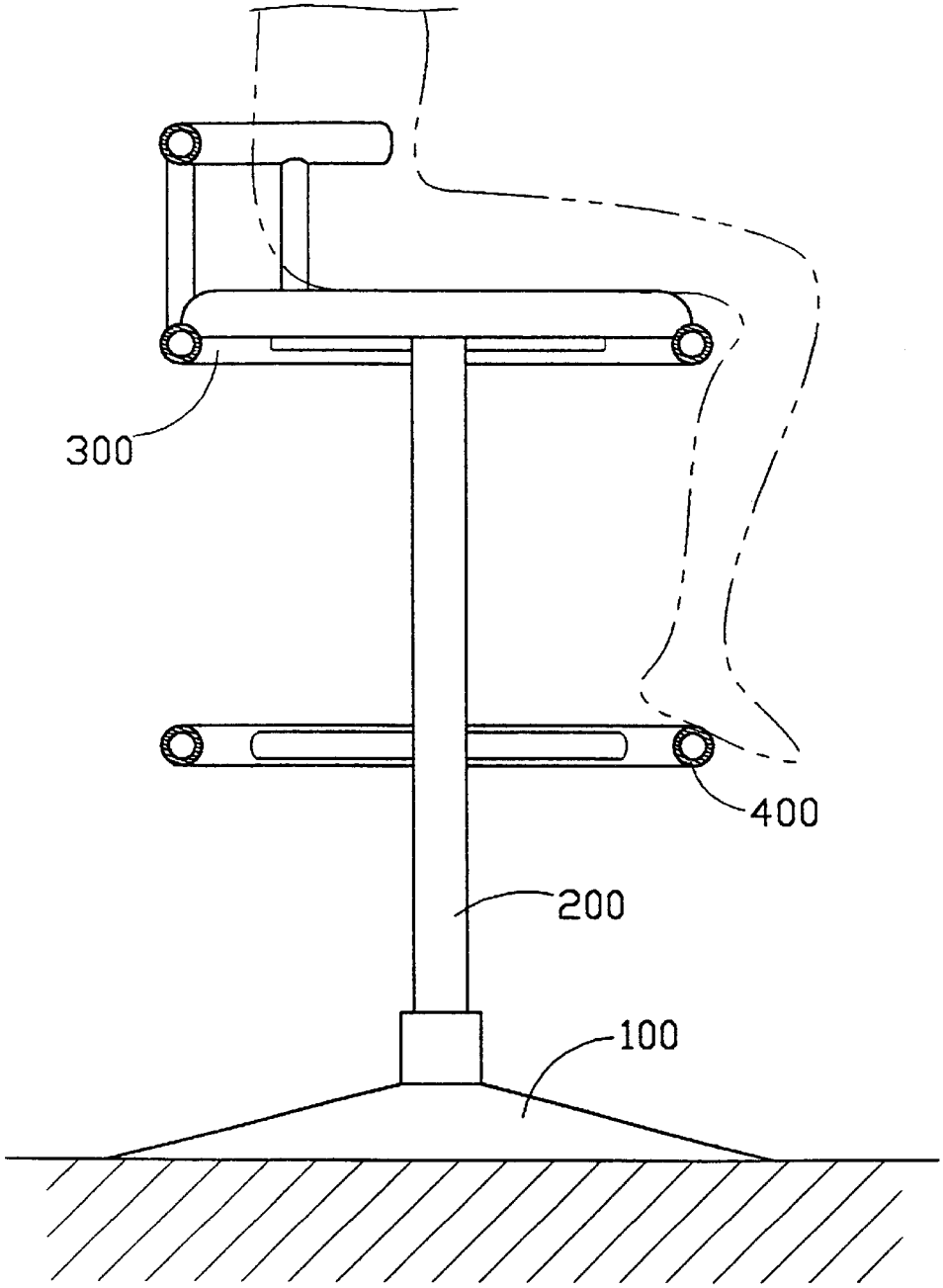
FIG. 1 PRIOR ART
FIG. 1 a cross sectional view to show a conventional stool.
Figure 2:
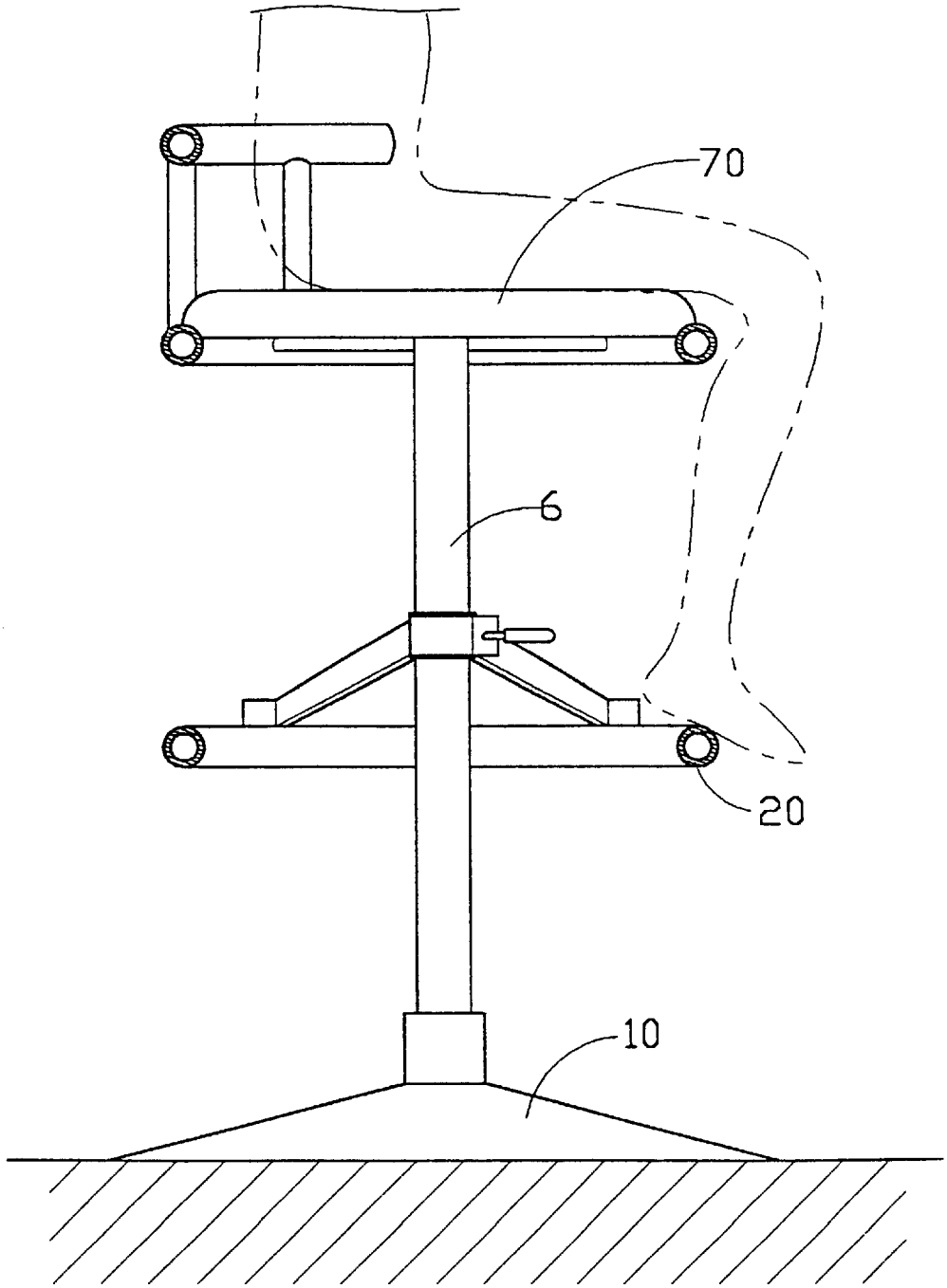
FIG. 2 is a cross sectional view to show the stool of the present invention.
Figure 3:
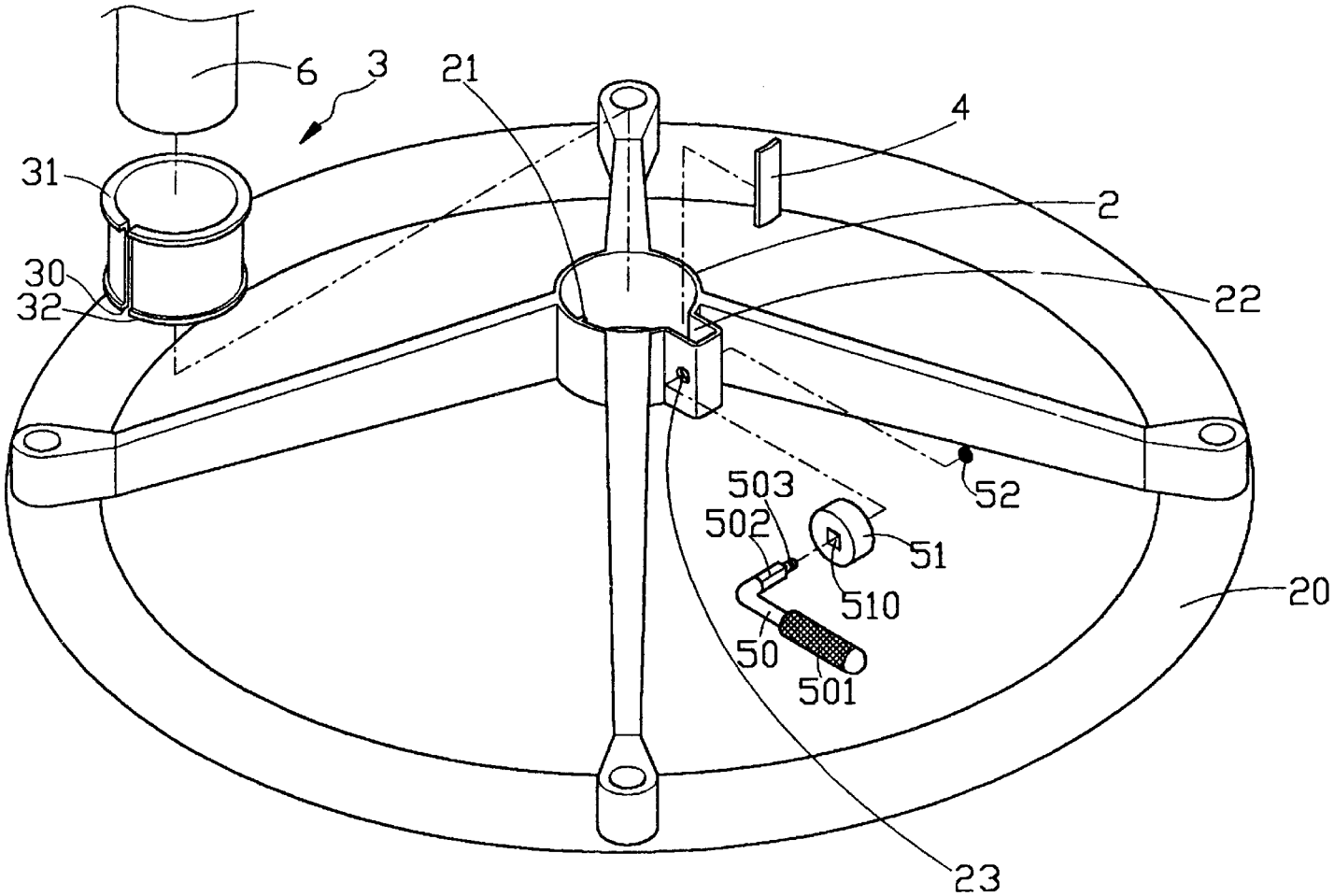
FIG. 3 is an exploded view to show the foot rest and the cam device of the foot rest.
Figure 6:
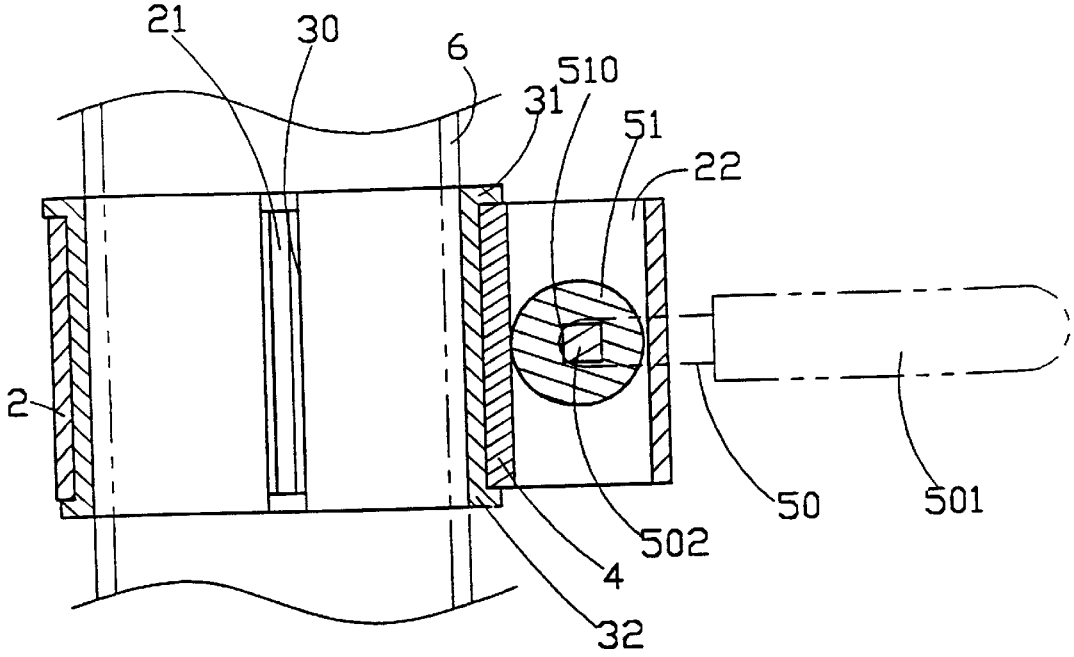
FIG. 6 is a cross sectional view to show the cam member is rotated to its fastening position.

Referring to FIGS. 2 and 3, the stool of the present invention comprises a base 10 and a post 6 extends from a top of the base 10 and a seat 70 is rotatably connected to a top of the post. A foot rest 20 is a ring-shaped member and a collar 2 is located at a center of the foot rest 20 with ribs connected between the collar 2 and the ring-shaped member.

The collar 2 has a protrusion 21 extends from the inner periphery thereof A recess 22 is defined in an inner periphery of the collar and a cam member 51 is received in the recess 22. The cam member 51 has an engaging hole 510 which is a rectangular hole defined eccentrically in the cam member 51. A lever 50 has a handle portion 501 and an engaging section 502 which extends through a hole 23 through a casing enclosing the recess 22 and is ir-rotationally engaged with the engaging hole 510. A threaded end 503 of the lever 50 extends out from the casing enclosing the recess 22 and is engaged with the nut 52.

A C-shaped fastening member 3 is received in the collar 2 and mounted to the post 6. The protrusion 21 is engaged with a slit 30 of the fastening member 3 so that the fastening member 3 is not rotated in the collar 2. A first flange 31 and a second flange 32 extend from two opposite edges of the fastening member 3 and are engaged with two ends of the collar 2 respectively so that the fastening member 3 does not drop from the collar 2. An urging plate 4 is located between the cam member 51 and the fastening member 30. The cam member 51 urges against an outside of the urging plate 4 which pushes and fastens the fastening member 3.

Figure 4:
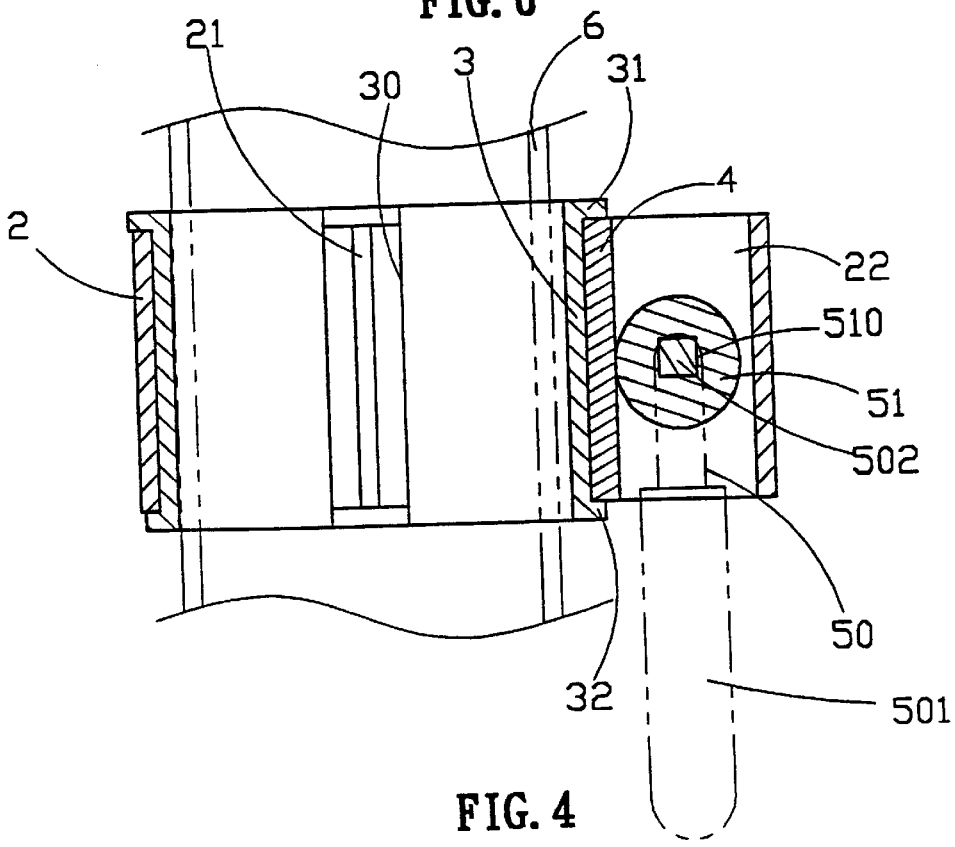
FIG. 4 is a cross sectional view to show the cam member is rotated to its releasing position.
Figure 7:
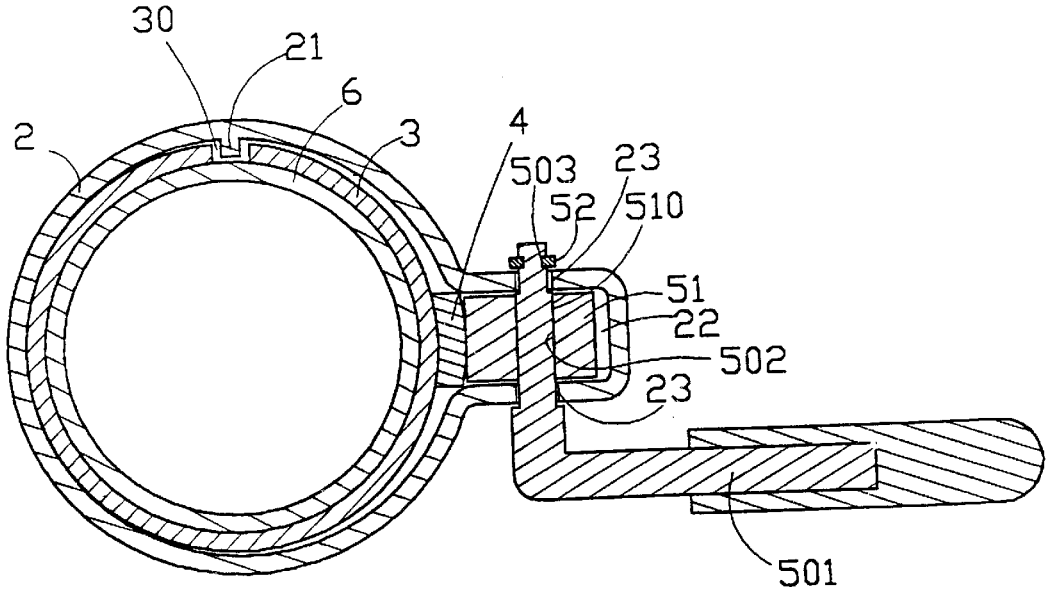
FIG. 7 shows that the post is fastened by the fastening member.
Figure 5:
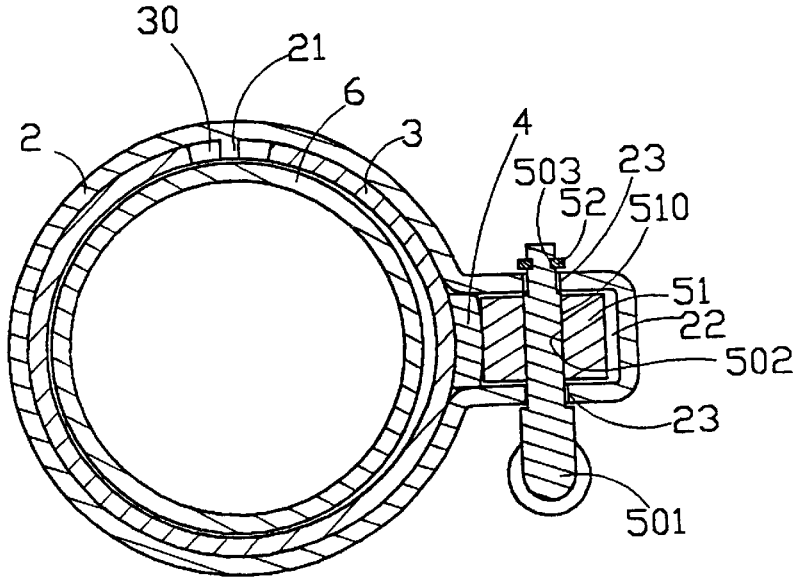
FIG. 5 shows that the post is not fastened by the fastening member.

Referring to FIGS. 4 and 5, when rotating the handle 501 of the lever 50 to its releasing position as shown, the cam member 51 does not urge the urging plate 4, the C-shaped fastening member 3 is loosened by the nature of the material so that the foot rest 20 can be moved along the post 6 to a desired position. The lever 50 is then rotated to its fastening position, the cam member 51 is rotated to urge the urging plate 4 which is pushes the fastening member 3 to secure the post 6.

The foot rest 20 can be easily adjusted to the desired position by the users and the operation action is finished simply by rotating the lever 50.

While we have shown and described the embodiment in accordance with the present invention, it should be clear to those skilled in the art that further embodiments may be made without departing from the scope of the present invention.

What is claimed is:

1. A stool comprising:

a base and a post extending from a top of the base;

a seat pivotably connected to a top of the post;

a foot rest having a collar and a recess defined in an inner periphery of the collar, the post extending through the collar, a cam member received in the recess and having an engaging hole defined eccentrically in the cam member, a lever having an engaging section securely engaged with the engaging hole, and a fastening member received in the collar and mounted to the post, the cam member urging against an outside of the fastening member.

2. The stool as claimed in claim 1, wherein the foot rest is a ring-shaped member and the collar is located at a center of the foot rest with ribs connected between the collar and the ring-shaped member.

3. The stool as claimed in claim 1 further comprising an urging plate located between the cam member and the fastening member.

4. The stool as claimed in claim 1, wherein the collar has a protrusion extends from the inner periphery thereof and the fastening member has a slit in which the protrusion is engaged, a first flange -and a second flange extending from two edges of the fastening member and engaged with two ends of the collar respectively.

* * * * *